US005894782A

United States Patent [19]

Nissen et al.

[11] Patent Number: 5,894,782

[45] Date of Patent: Apr. 20, 1999

[54] COMPRESSOR

[75] Inventors: Harry Stentoft Nissen, Sønderborg; Stig Helmer Jørgensen, Nordborg, both of Denmark

[73] Assignee: Danfoss A/S, Nordborg, Denmark

[21] Appl. No.: 08/859,992

[22] Filed: May 21, 1997

[30] Foreign Application Priority Data

May 24, 1996 [DE] Germany ..... 196 21 174
Jan. 9, 1997 [DE] Germany ..... 971 00 207

[51] Int. Cl.[6] ..... F01B 3/00

[52] U.S. Cl. ..... 92/12.2; 92/71; 74/60; 91/504

[58] Field of Search ..... 74/60; 92/12.2, 92/71; 417/269; 91/504, 505

[56] References Cited

U.S. PATENT DOCUMENTS 2,915,985 12/1959 Budzich ..... 92/12.2
3,319,576 5/1967 Orshansky, Jr. ..... 91/504
3,463,087 8/1969 Grant ..... 91/505
5,391,058 2/1995 Goto et al. ..... 417/269

FOREIGN PATENT DOCUMENTS 636201 4/1950 United Kingdom ..... 91/505

*Primary Examiner*—Thomas E. Denion
*Attorney, Agent, or Firm*—Lee, Mann, Smith, McWilliams, Sweeney & Ohlson

[57] ABSTRACT

A compressor (1) with at least one piston (9) movable in a cylinder (10), a drive shaft (2) and a wobble plate arrangement (4, 5) between piston (9) and drive shaft (2), having an inclined plate (4) with variable inclination angle, and with a spring arrangement (17; 41 to 43), acting on the wobble plate arrangement in the direction of a minimum displacement. Such a compressor should also be able to operate at higher pressures without increasing its size, e.g. to enable the use of $CO_2$ as refrigerant. For this purpose the spring arrangement (17; 41 to 43) acts on the wobble plate arrangement (4, 5) in the area of the radial edge.

14 Claims, 3 Drawing Sheets

1
2
3
4
5
6
7
8
9
10
11
12
13
14
15
16
17
18
19
20
21
22
23
24
25
26
27
28
29
30
31
32
33
34
35
36
37
38
39

FOR COMPRESSOR

BACKGROUND OF THE INVENTION

The invention concerns a compressor with at least one piston movable in a cylinder, a drive shaft, and a wobble plate arrangement between piston and drive shaft, having an inclined plate with variable inclination angle, and with a spring arrangement acting on the wobble plate arrangement in the direction of a minimum displacement.

Such a compressor is known from U.S. Pat. No. 5,387,091.

Compressors of this kind are e.g. applied in vehicle air-conditioning systems. In view of the increasing attention on environmental loads, attempts have been made in recent years to find replacements for the environmentally harmful refrigerants used till now. Particularly in the field of vehicles there is a risk that an accident may cause such refrigerants to emerge and escape into the environment. E.g. carbon dioxide ($CO_2$) may be considered as new refrigerant. However, this refrigerant requires relatively high pressures, so the force to be applied by the spring must be correspondingly high. On the other hand, however, an increase in the size of the compressor is not wanted. Particularly in the vehicle field, where such compressors must be placed in the engine compartment, the space available is limited.

SUMMARY OF THE INVENTION

The task of the invention is to enable operation of the compressor also at higher pressures.

With a compressor as mentioned in the introduction this is solved in that the spring arrangement acts on the wobble plate arrangement in the area of the radial edge.

On the one hand this embodiment involves the opportunity of increasing the size of the spring without having to increase the size of the whole compressor. The wobble plate arrangement must have a certain diameter, in order that the pistons can move up and down correspondingly. Thus this space in the radial direction is required and available anyway. On the other hand the present compressors also require and have a certain axial extension to enable the placing of the spring. Combining these two possibilities enables the placing of a spring arrangement on a relatively short axial extension, which provides the required spring force. Correspondingly, the compressor can also operate at higher pressures. This offers an additional advantage, which is particularly important in connection with high pressures. The fact that the wobble plate arrangement is supported in the area of its radial edge counteracts a tilting of the wobble plate arrangement caused by the counterforces applied by the pistons. It is necessary to change the angle of the inclined plate to influence the performance of the compressor. However, this change must be targeted, not effected accidentally under the influence of a torque applied by the piston/pistons. Such a torque can also cause a jamming of the wobble plate arrangement, which again influences the adjustability. The increase in size of the spring arrangement in the radial direction in relation to the state of the art offers an elegant method of avoiding this problem.

Preferably, the spring arrangement is arranged next to a wall surrounding an interior space of the compressor. Thus the space inside the compressor is utilised to an optimum. A diameter increase of the compressor to the outside is not required. However, it is still possible to place the spring arrangement in a relatively far out radial position.

Preferably, the spring arrangement is arranged substantially on the same radius as the piston. Thus the power applied by the piston will be counteracted where it occurs. Piston and power application spot of the spring arrangement are then placed substantially on the same axial line.

Advantageously the spring arrangement is fitted between the wobble plate arrangement and a rotatably arranged basis plate. Thus the large spring arrangement diameter can also be maintained on the side turning away from the wobble plate arrangement. The spring as a whole can thus be placed in an at least approximately cylindrical space, without having to narrow for support purposes.

In a particularly preferred embodiment it is provided that the spring arrangement is arranged radially outside a change mechanism for the inclination angle of the inclined plate. This also causes that the forces of the spring arrangement act approximately where the counterforces of the piston/pistons appear. Besides, this method provides that spring arrangement and change mechanism do not obstruct each other. Radially inside the spring arrangement there is enough space for the arrangement of the change mechanism.

Preferably, the wobble plate arrangement has a pressure plate, on which the spring arrangement is bearing. This gives a relatively large surface, which is able to absorb the forces of the spring arrangement and pass them on to the wobble plate arrangement.

In this connection, it is particularly preferred that the change mechanism goes through an opening in the pressure plate. This ensures that additional head room of the compressor is not required, even when a pressure plate is used. Pressure plate and change mechanism can practically be wrapped up in each other. In spite of the presence of the change mechanism, an admission of the pressure plate can still be effected in the desired spot. The spring arrangement does not impose any limits with regard to the arrangement of the change mechanism.

Advantageously, the pressure plate has a neck surrounding drive shaft and bearing on a bearing arrangement of the inclined plate arranged axially displaceably on the main shaft. This neck, i.e. a circumferential projection protruding axially from the pressure plate secures on the one hand a relatively good axial guiding of the pressure plate on the drive shaft. This prevents a tilting of the pressure plate in relation to the drive shaft. Further, this method provides simple transmission opportunities for the forces from the spring arrangement via the pressure plate to the wobble plate arrangement.

Preferably, the wobble plate arrangement has a wobble plate being rotatable in relation to both the inclined plate and the piston. During operation, the inclined plate will then rotate at a speed lying somewhere between the speed of the drive shaft, with which the inclined plate rotates, and zero, which corresponds to the "speed" of the piston. The speed of the wobble plate will automatically adapt so that only the lowest energy consumption is required. In other words, losses are kept as small as possible. For one, this embodiment provides that the wobble plate can act radially relatively far out, so that the pistons are substantially axially loaded. This secures that the pistons in the cylinders are not loaded unilaterally, which reduces wear. On the other hand, large relative speeds between pistons and wobble plate are not required, which again would lead to higher losses in the bearing.

Advantageously, the wobble plate is supported in relation to the inclined plate radially inside or in the area of the change mechanism. This secures that the pressure forces of the pistons can be transmitted more or less directly to the pressure plate.

In a preferred embodiment, the spring arrangement has a spring arranged coaxially around the drive shaft. Thus the spring surrounds the drive shaft, if required, at a certain distance. This is a very simple possibility, particularly with regard to the fitting.

In this connection it is preferred that in the circumferential direction the spring has an uneven pressure distribution and that a torsion-preventing and positioning arrangement is provided, fixing the area with the highest pressure in the top dead centre area of the inclined plate. An embodiment of this kind occurs e.g. when the spring is a helical spring, whose front ends are made parallel to each other, e.g. by means of face grinding. In this case an uneven pressure distribution will occur in the circumferential direction. E.g. the counterpower of the spring will be lower where the face grinding has led to a decreased thickness of the last spring winding. On the other hand the counterpower imposed by the pistons in the circumferential direction is not even either. Shortly before reaching the top dead centre of the inclined plate, i.e. the point, in which the inclined plate takes the piston to one of its end positions, the compression of the gas in the cylinder is highest. Correspondingly, the counterforce imposed by the piston is also the highest. At this instant, however, the outlet valve opens, so that the compressed gas is led away by the ongoing movement of the piston towards the bottom of the cylinder. When the outlet valve opens, at least an additional pressure increase will not occur. In most cases, a more or less sudden pressure relief will occur. When combining these two effects, i.e. the area of the spring in the circumferential direction with the highest spring force and the position of the inclined plate, on which the highest counterforce may be expected, both of these events can be approximately compensated. This only requires fitting and fixing of the spring in the correct angle position. When it is secured that the compressor is only operated in one direction of rotation, the area with the highest counterforce can be positioned somewhat before the top dead centre of the inclined plate. When the direction of rotation is not known for sure, or a change may be expected, this area can also be fixed exactly at the top dead centre. This is sufficient for the absorption of the loads near the top dead centre.

In an alternative embodiment it is provided that the spring arrangement has several individual springs arranged at predetermined spaces in a row around the main shaft. On the one hand, such individual springs also provide the required spring force amplification. The force on the wobble plate arrangement then results from the sum of the forces of the individual springs. On the other hand, this also provides a compensation of the load where it occurs, i.e. more or less on the same axial line, on which also the pistons are arranged.

In this connection it is particularly preferred that the individual springs have different spring constants. In this way it is considered that, as stated above, an uneven power distribution is acting on the wobble plate arrangement in the circumferential direction. In the point where the piston is close to its top dead centre, the counterforce is highest. Thus it is sufficient also to fit the correspondingly strong springs there. The remaining springs can then be weaker. In fact, they only serve the purpose of stabilising the wobble plate arrangement, i.e. they have to prevent uncertain tilting.

Preferably, at least one individual spring is arranged at a predetermined angle before the top dead centre of the inclined plate. As mentioned above, this is the point, in which the highest load may be expected. When the machine is to be operated in both directions of rotation, it is expedient to use two individual springs.

In the following the invention is described on the basis of a preferred embodiment in connection with the drawings, showing:

DESCRIPTION OF THE PREFERRED EMBODIMENTS

Figure 1:
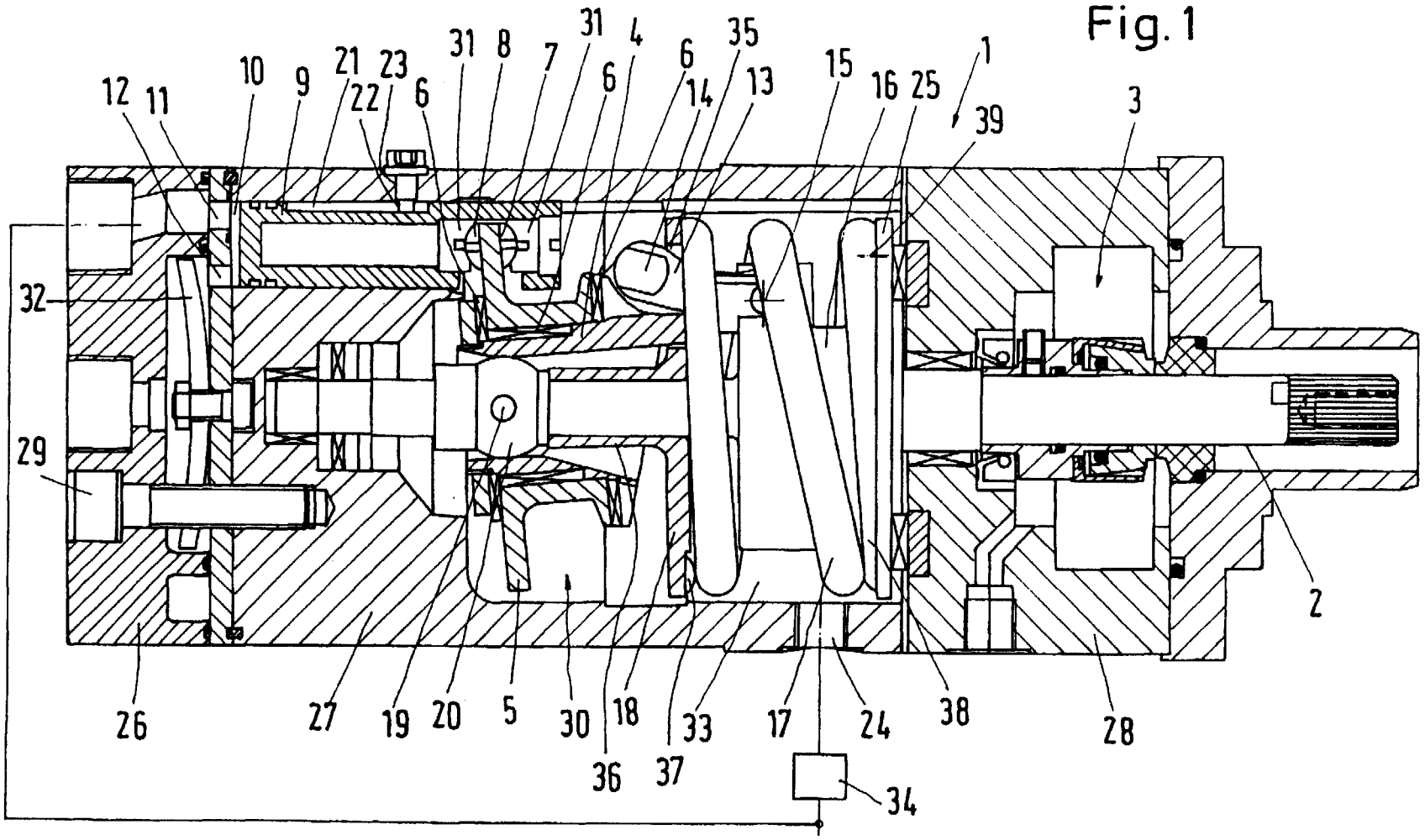
FIG. 1 a first embodiment of a compressor

A compressor 1 (FIG. 1) has a drive shaft 2. Therefore, it is also called a shaft-operated compressor. The drive shaft 2 is led through a shaft guide 3 into a housing, comprising a front part 26, a middle part 27 and a rear part 28. The housing parts 26, 27 and 28 are connected with each other in the axial direction by known means, e.g. threaded bolts 29.

In the middle part 27 of the housing, several cylinders 10 are arranged in the circumferential direction, of which only one is shown. Each cylinder 10 comprises a piston 9, movable up and down in the axial direction. The driving of the piston 9, or the pistons 9, resp., is effected via a wobble plate arrangement 30. The wobble plate arrangement 30 has a wobble plate 5 arranged rotatably on an inclined plate 4. For this purpose a needle bearing 6 or another friction reducing bearing is provided between wobble plate 5 and inclined plate 4.

Wobble plate 5 is connected with piston 9 via slide bearings 7. Slide bearings 7 have semi-spherical-like slide shoes 8, bearing on wobble plate front and end, i.e. axially from both sides. The slide shoes 8 are received by corresponding, negatively shaped bearing shells, which again are fixed in piston 9.

Through slide bearing 7 wobble plate 5 can on the one hand move freely in relation to piston 9. On the other hand, however, the radial positioning of wobble plate 5 in relation to piston 9 can also change. This means e.g. that a change of the inclination of inclined plate 4 will cause that the wobble plate acts radially further outside or further inside in relation to piston 9. In the shown position of inclined plate 4, the wobble plate is radially relatively far out. When the angle between inclined plate 4 and drive shaft 2 increases, wobble plate 5 with its slide surface withdraws correspondingly radially inwards. This causes that the force admitted on the pistons 9 is always substantially parallel to their movement direction.

In a commonly known way, cylinder 10 is provided with a suction valve opening 11, via which a refrigerant can be drawn in. Further, a pressure valve opening 12 is provided, via which compressed refrigerant can be led out from the cylinder. The pressure valve opening 12 can be closed by a valve element 32. Corresponding valves for the suction valve opening 11 are not shown, but are part of the compressor.

For the operation of inclined plate 4, a basic plate 16 is unrotatably connected with drive shaft 2. A hinged arm 13 is unrotatably connected with basic plate 16. On a rotation of the basic plate 16 the hinged arm 13 is carried along. In a rotation point 14 the inclined plate 4 is connected with the hinged arm 13, i.e. it is tiltable around this rotation point 14. The hinged arm 13 is again connected with the basic plate 16 via a rotation point 15. On tilting of the inclined plate 4, certain changes in the leverage created by the hinged arm 13 can thus be absorbed in the radial direction, meaning that the tilting point of the inclined plate can move within certain limits.

A flange 25 is arranged on and unrotatably connected with the basic plate 16. A pressure plate 18 is arranged axially displaceably on drive shaft 2. A pressure spring 17 is fitted between pressure plate 18 and flange 25. The pressure spring 17 pushes the pressure plate 18 forward, i.e. to the left in the figure, and thus pushes the inclined plate 4 in the same direction. As the inclined plate 4 is connected with the basic plate 16 via the hinged arm 13, this causes the inclined plate to tilt slightly, so that the piston 9 carries through a correspondingly small stroke.

For this purpose the inclined plate 4 is not only tiltable around its tilting point, it also rotates around a rotation point 19 of a guiding arrangement 20, which is axially displaceable on the drive shaft 2 together with the pressure plate 18.

The pressure plate 18 has a through-opening 35, through which the hinged arm 13 passes. The pressure spring has a relatively large diameter, i.e. it surrounds the drive shaft 2 coaxially, and additionally, it can also surround the outside of the hinged arm 13. This enables a pressure admission relatively far out on the pressure plate 18, without influencing the function of the hinged arm 13 by the pressure spring 17. Correspondingly, this has a positive effect on the dimensioning of the pressure spring 17 and on the size of the compressor 1.

The pressure spring 17 surrounds the shaft 2 coaxially. It engages the pressure plate 18 relatively far out, viz. in the area of its radial edge. Thus, the pressure spring 17 has practically the largest possible diameter. It is arranged next to the wall of the inside of the housing 33, which is here formed by the middle part 27. Of course a certain space is provided, as the pressure spring 17 rotates together with the drive shaft 2.

The pressure spring 17 practically forms a hollow cylinder. The cylinder wall is arranged on the same circumferential line as the pistons 9.

The pressure plate 18 has a neck 36, with which it bears on the drive shaft 2. The neck 36 surrounds the drive shaft and provides that also at a possible unilateral load the pressure maintains its positioning vertically to the drive shaft 2. The neck 36 of the pressure plate 18 acts against the guiding arrangement 20 for the inclined plate 4.

Being designed as a helical spring, flattened on both front ends, the pressure spring 17 has an uneven pressure distribution in the circumferential direction. This is among other things due to the fact that the end windings 37, 38 of the pressure spring 17 have a decreasing power. Now, the pressure spring 17 is positioned and fixed in relation to the pressure plate 18, e.g. by means of a pin 39, in a way that the angle area with the largest power lies below the top dead centre of the inclined plate 4. The top dead centre is the point, in which the pistons 9 assume their largest deflection and the cylinder 10 assumes it smallest volume. Shortly before this operation position the gas volume enclosed in the cylinder 10 exerts its largest counterpressure on the pistons and thus also on the pressure spring 17. Thus, it would be even better, if the angle area of the pressure spring 17 having the largest power was placed somewhat before the top dead centre. In the top dead centre the cylinder 10 is namely already empty again, so that the largest forces appear shortly before this top dead centre. As operation in both directions of the compressor is often desired, it is sufficient to have the largest counterforce below the top dead centre.

The cylindrical surface area of the piston 9 is provided with a groove. This groove is engaged by a pin 22, formed e.g. by the end of a screw 23, screwed radially into the middle part 27 of the housing from the outside. Together with the groove 21 the pin 22 forms a torsion prevention for the piston 9.

During its up- and down-movement the piston 9 is drawn somewhat into the inside of a housing 33. In this connection, it is almost unavoidable that a small quantity of particularly gaseous refrigerant escapes or leaks into the inside of this housing 33. This continuous flow of refrigerant leads to an increased pressure in the inside of the housing 33. To drain this pressure, an opening 24 is provided, which is connected with a schematically shown valve 34. By means of this valve 34, the pressure inside the housing can be reduced. The other side of the valve can e.g. be connected with the suction valve opening 11, so that the pressure on the inside of the housing 33 can only be reduced to match the suction pressure of the compressor.

Now, e.g. the inclination of the inclined plate 4 and thus the output of the compressor 1 can be controlled by means of the pressure on the inside of the housing 33. When the pressure on the inside of the housing 33 is as large as or almost as large as the pressure at the pressure valve opening, both ends of piston 9 are almost at balance. In this case, only small reaction forces affect the inclined plate 4, so that the pressure spring 17 moves the inclined plate 4 to the position shown in the figure. When, however, the pressure on the inside of the housing 33 is reduced, increased forces are affecting the spring 17, so that the inclination of the inclined plate 4 is increased.

The compressor now works as follows:

When the drive shaft 2 rotates, the basic plate 16 rotates with it. Via the hinged arm 13 the basic plate brings along the inclined plate 4. Thus the wobble plate 5 assumes a wobbling movement, so that the piston is moved up and down. Depending on the pressure on the inside of the housing 33, the inclined plate 4 is more or less inclined by the corresponding reaction forces.

The change of the inclination of the inclined plate 4 also changes the position of the wobble plate 5 in relation to the slide bearing 7, i.e. the slide bearing 7 between wobble plate 5 and piston 9 is positioned radially more or less far out on the wobble plate. A position is assumed, in which the lowest forces are ruling.

The wobble plate 5 can still move freely in relation to the piston 9. It can also rotate freely in relation to the inclined plate 4, meaning that the wobble plate 5 assumes a speed, at which the frictional forces are as low as possible. Thus, it is possible for the compressor 1 to work with a relatively high efficiency and relatively low wear. The forces acting on the piston 9 are practically only axial forces, to avoid a tilting of the piston 9 in relation to the cylinder 10. This reduces the wear and increases the tightness of the compressor 1.

Figure 2:
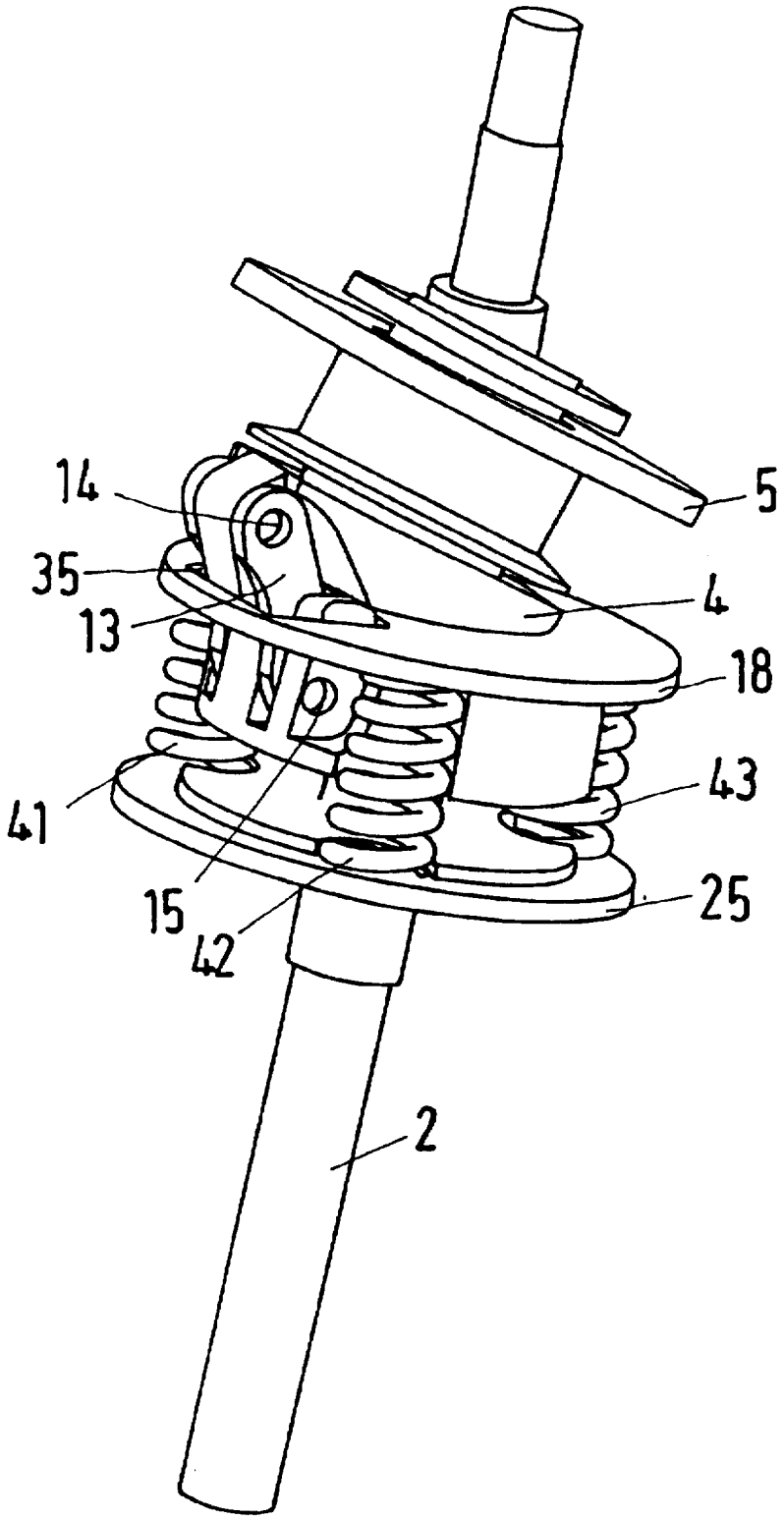
FIG. 2 a second embodiment showing an embodiment of a wobble plate arrangement with spring arrangement FIG. 3 a third embodiment of a compressor

FIG. 2 shows a drive shaft 2 with wobble plate arrangement, in which only the design of the spring arrangement has been changed. The remaining parts correspond to the parts in FIG. 1. Thus, they have the same reference numbers.

In stead of the one pressure spring 17, three individual springs 41, 42, 43 are provided, all made as pressure springs, and arranged between the flange 25 and the pressure plate 18. The pressure springs 41 to 43 are also arranged so that they engage radially as far out as possible, i.e. in the area of the edge of pressure plate 18. In this connection the springs are arranged on a circle. This is an advantage, but not an absolute requirement. In the embodiment shown, the springs form an isosceles triangle, whose basis is limited by the springs 41, 42. This embodiment is also advantageous, but not an absolute requirement.

The spring 43 has a weaker spring constant than the springs 41, 42, which are arranged next to the hinged arm 13. The hinged arm 13 is placed where the inclined plate 4 has its top dead centre. The springs 41, 42 are placed at predetermined angles before and after this top dead centre, i.e. exactly where the compressed gas in the cylinder 10 develops its largest resistance, before it escapes from the cylinder 10. In fact, only one of these two springs 41, 42 is required. However, the second spring is provided to enable operation of the compressor in both directions. The purpose of the third spring 43 is merely stabilisation, to prevent the pressure plate 18 from tilting.

The three individual springs can also provide a larger spring force than the known single spring, arranged around the drive shaft 2. Independently of whether the spring arrangement is made as a pressure spring 17, surrounding the drive shaft 2 at as large a radius as possible, or is made up of individual springs 41 to 43, this method provides a compressor operable at high pressure, without requiring significant increase in size.

Figure 3:
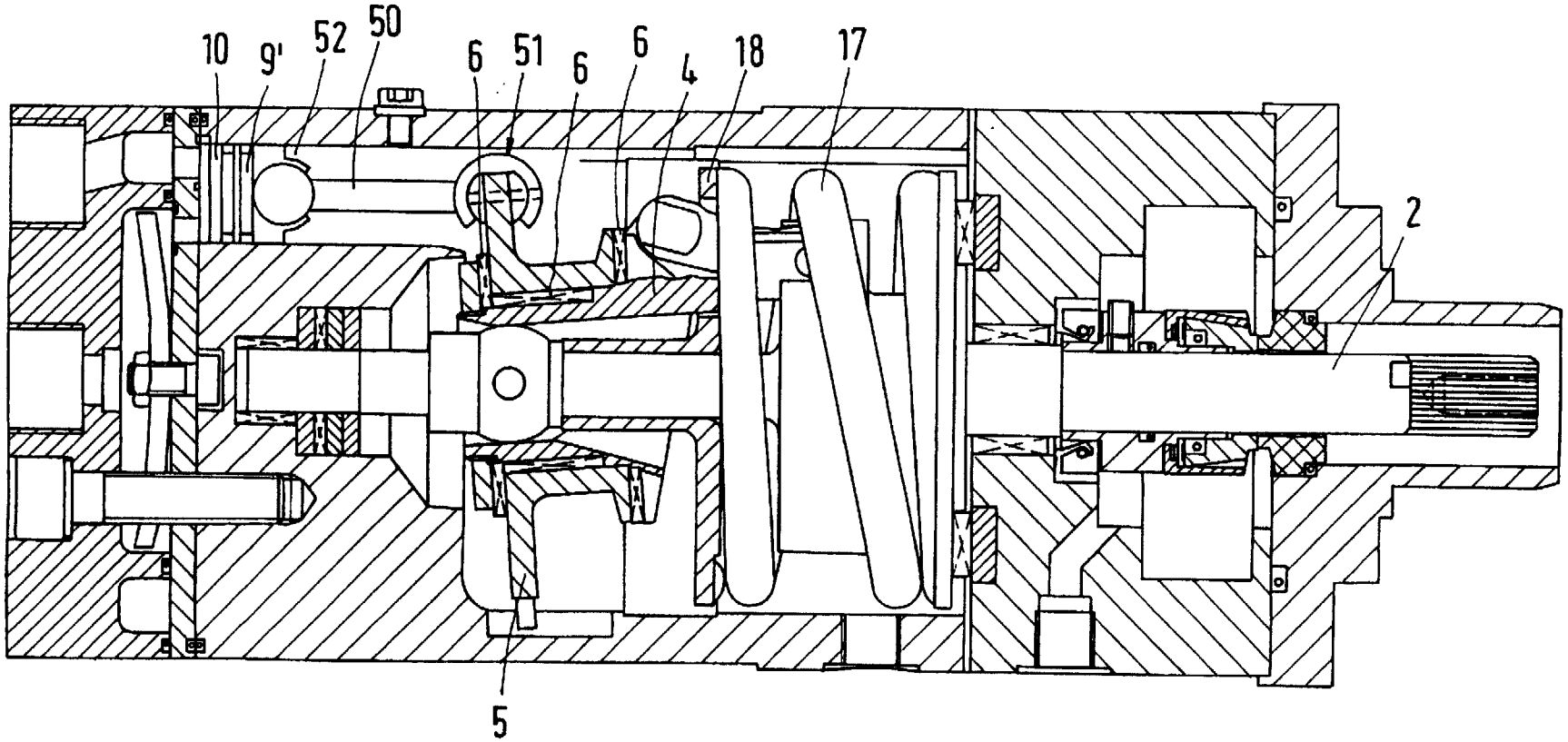

FIG. 3 shows a third embodiment of a compressor, corresponding substantially to the one in FIG. 1.

Differently from the embodiment according to FIG. 1, the driving of piston 9' in FIG. 3 takes place via piston rods 50, which are connected with wobble plate 5 via a ball-and-socket joint 51. The ball-and-socket joint only permits a swivel motion of the piston rod 50 in relation to the wobble plate 5. Another movement is not possible. Thus the wobble plate 5 can move neither in the circumferential nor in the radial direction in relation to the ball-and-socket joint 51. Correspondingly, the speed difference between the stationary pistons 9' and the rotating shaft 2 must be completely absorbed by the bearings 6 between the inclined plate 4 and the wobble plate 5.

Changes in the driving geometry, originating from e.g. a change of the inclination angle of the inclined plate 4, are equalised by a different angle of the piston rod 50. This is possible, as also the piston has a ball-and-socket joint 52, with which the piston rod 50 is connected with the piston 9'. A change of the inclination of the piston rod 50 does thus not necessarily cause a deterioration of the driving geometry of the piston 9' in its cylinder 10.

Due to the pressure spring 17 acting on the edge of the pressure plate 18, also smaller inclination positions of the piston rod 50 cause no problems.

We claim:

1. Compressor with at least one piston movable in a cylinder, a drive shaft and a wobble plate arrangement between the piston and the drive shaft and having an inclined plate with variable inclination angle, and further having a spring arrangement acting on the wobble plate arrangement in the direction of a minimum displacement, the spring arrangement acting on the wobble plate arrangement in a radial edge area, the wobble plate arrangement having a pressure plate upon which the spring arrangement bears.

2. Compressor according to claim 1, in which the spring arrangement is arranged next to a wall surrounding an interior space of the compressor.

3. Compressor according to claim 1 in which the spring arrangement is arranged substantially on the same radius as the piston.

4. Compressor according to claim 1, in which the spring arrangement is fitted between the wobble plate arrangement and a rotatably arranged basis plate.

5. Compressor according to claim 1, in which the spring arrangement is arranged radially outside a change mechanism for the inclination angle of the inclined plate.

6. Compressor according to claim 1, in which a change mechanism goes through an opening in the pressure plate.

7. Compressor according to claim 1, in which the pressure plate has a neck, surrounding the drive shaft and bearing on a bearing arrangement of the inclined plate arranged axially displaceably on the drive shaft.

8. Compressor according to claim 1, in which the wobble plate arrangement has a wobble plate being rotatable in relation to both the inclined plate and the piston.

9. Compressor according to claim 8, in which the wobble plate is supported in relation to the incline plate radially inside or in the area of the adjusting mechanism.

10. Compressor according to claim 1, in which the spring arrangement has a spring arranged coaxially around the drive shaft.

11. Compressor according to claim 10, in which in the circumferential direction the spring has an uneven pressure distribution and that a torsion-preventing and positioning arrangement is provided, fixing the area with the highest pressure in the top dead centre area of the inclined plate.

12. Compressor according to claim 1, in which the spring arrangement has several individual springs arranged at predetermined spaces in a row around the drive shaft.

13. Compressor according to claim 12, in which the individual springs have different spring constants.

14. Compressor according to claim 12, in which at least one individual spring is arranged at a predetermined angle before the top dead centre of the inclined plate.

* * * * *